US005568751A

United States Patent [19]

Lee

[11] Patent Number: 5,568,751

[45] Date of Patent: Oct. 29, 1996

[54] REVERSIBLE RATCHET WRENCH AND REVERSIBLE RATCHET MECHANISM THEREOF

[76] Inventor: Chang C. Lee, 429-6, Chung Cheng Road, Tsaotun, Nantou, Taiwan

[21] Appl. No.: 510,416

[22] Filed: Aug. 2, 1995

[51] Int. Cl.[6] ..... B25B 13/46

[52] U.S. Cl. ..... 81/63; 192/43.1

[58] Field of Search ..... 81/60, 63; 192/43.1

[56] References Cited

U.S. PATENT DOCUMENTS

| | | | |
|---|---|---|---|
| 3,233,481 | 2/1966 | Bacon | 81/63 |
| 3,677,102 | 7/1972 | Simonetta | 81/63 X |
| 4,307,632 | 12/1981 | Penner | 81/63 |
| 4,612,830 | 9/1986 | Yang . | |

*Primary Examiner*—James G. Smith

*Attorney, Agent, or Firm*—Bacon & Thomas

[57] ABSTRACT

A reversible ratchet mechanism comprises a cylindrical head having axially a center hole in which the cylindrical body of a torsion transmitting element is rotatably disposed. The cylindrical body is provided axially with a V-shaped slot in which a V-shaped pawl is fastened pivotally such that two arms of the V-shaped pawl form an angle smaller than the V-shaped slot. Two arms of the pawl are provided respectively on the top end thereof with a plurality of pawl teeth engageable with a plurality of axial teeth provided on an inner wall surface of the center hole of the cylindrical head. Fastened pivotally to the cylindrical body is a round rod which is located between the two arms of the pawl and is provided at the midsegment thereof with a spring-biased pin capable of urging either one of the two arms of the pawl depending on the angular position of the round rod, thereby resulting in the engagement of the pawl teeth with the axial teeth of the center hole of the cylindrical head.

4 Claims, 3 Drawing Sheets

REVERSIBLE RATCHET WRENCH AND REVERSIBLE RATCHET MECHANISM THEREOF

FIELD OF THE INVENTION

The present invention relates to a reversible ratchet mechanism suitable for use in the ratchet wrench.

BACKGROUND OF THE INVENTION

As described in detail in the background of the invention in conjunction with FIGS. 1 and 2 of the U.S. Pat. No. 4,612,830, the so-called Snap-On ratchet wrench is one of the most widely-used ratchet wrenches of the prior art. Such a Snap-On ratchet wrench as mentioned above is defective in design in that it is rather complicated in construction and that it must be made with a great deal of precision. Therefore, the afore-mentioned U.S. patent discloses a ratchet wrench which is intended to overcome the shortcomings of the conventional Snap-On ratchet wrench; nevertheless it is composed of a pawl which is rather complicated in construction and must be made with an extremely high precision. The pawl is provided respectively at both ends thereof with an arcuate peripheral surface which is inversely angled, so as to enable the ratchet wrench to bring about the ratcheting of the ratchet mechanism. In addition, the pawl is provided on the midsection of one end thereof with a recess which must have an appropriate depth to enable one side of the pawl to be pressed against by a spring-biased pin. In the meantime, when the pawl is so moved as to allow a change in the direction in which the ratchet wrench is driven, the top end of the spring-biased pin must be allowed to pass over the recess to press against another side of the pawl. The outer surface of the recess must be of an arcuate construction so as to enable the top end of the spring-biased pin to pass over the recess easily. If the depth of the recess is excessive, it is very likely that the spring-biased pin is trapped in the recess and that the spring-biased pin is unable to press against the side of the pawl. On the other hand, if the depth of the depth of the recess is insufficient, the top end of the spring-biased pin is unable to pass over the recess to press against another side of the pawl. As a result, the direction in which the ratchet wrench is driven can not be changed. It is therefore readily apparent that the ratchet wrench disclosed in the above-mentioned U.S. Pat. No. 4,612,830 shares the similar shortcomings with the conventional Snap-On ratchet wrenches which are intended to be overcome. Moreover, the recess of the pawl of the ratchet wrench of the prior art reduces the destructive torsion value of the reversible ratchet wrench.

SUMMARY OF THE INVENTION

It is therefore the primary objective of the present invention to provide a reversible ratchet mechanism which can be made easily and has a high destructive torsion value.

it is another objective of the present invention to provide a ratchet wrench which can be made easily and has a high destructive torsion value.

The foregoing objectives of the present invention are attained by the reversible ratchet mechanism comprising a hollow cylindrical head, a torsion transmitting element, a pawl and a round rod. The cylindrical head has a center hole provided axially on the inner wall surface thereof with a plurality of teeth. The torsion transmitting element is provided at one end thereof with a driving rod and at another end thereof with a cylindrical body which is received rotatably in the center hole of the cylindrical head. The driving rod is extended vertically out of one side of the cylindrical head. The cylindrical body is provided axially with a V-shaped slot which is provided radially at the bottom thereof with an arcuate recess. The V-shaped slot is further provided with two openings which are separated and located on the periphery of the cylindrical body. The pawl is of a V-shaped construction and has two arms which form an angle smaller than the V-shaped slot and are provided respectively on a top end thereof with one or more teeth. The V-shaped pawl is mounted pivotally in the V-shaped slot such that the teeth of two arms of the V-shaped pawl are located respectively in the openings of the V-shaped slot. The round rod is provided on the midsegment of the longitudinal axis thereof with a spring-biased pin, which is fastened pivotally and axially with the cylindrical body at a location between two arms of the pawl such that the pin presses against the inner side of the V-shaped pawl. The round rod can be turned to select either one of the two arms of the pawl to be pressed against by the pin, thereby causing the teeth of said pressed arm to engage the teeth of the center hole of the cylindrical head.

The foregoing objectives of the present invention are further attained by the reversible ratchet wrench comprising the reversible ratchet mechanism described above, a handle, a fastening mechanism, and a rotating button. The handle is extended outwardly and vertically from the outer peripheral surface of the hollow cylindrical head. The fastening mechanism is intended to fasten the ratchet mechanism with the center hole of the cylindrical head. The rotating button is fastened to one end of the round rod of the ratchet mechanism such that the rotating button is located farther front the driving rod. It is preferable that the fastening mechanism comprises a circular groove which is located between the cylindrical body and the driving rod and is dimensioned to receive therein a C-shaped ring, a flange which is formed on one end of the cylindrical body and is located farther from the driving rod, and a cover which is fastened to one end of the cylindrical body and is located farther from the driving rod. The cover is shaped and dimensioned to cover the V-shaped slot. The cover is provided with a through hole via which one end of the round rod of the ratchet mechanism protrudes and fastens to said rotating button. The cover has a surface which makes contact with the rotating button and is provided with a sectoral recess or two spaced projections for limiting the rotating button to be turned within a fixed range.

DETAILED DESCRIPTION OF THE EMBODIMENTS

Figure 1:
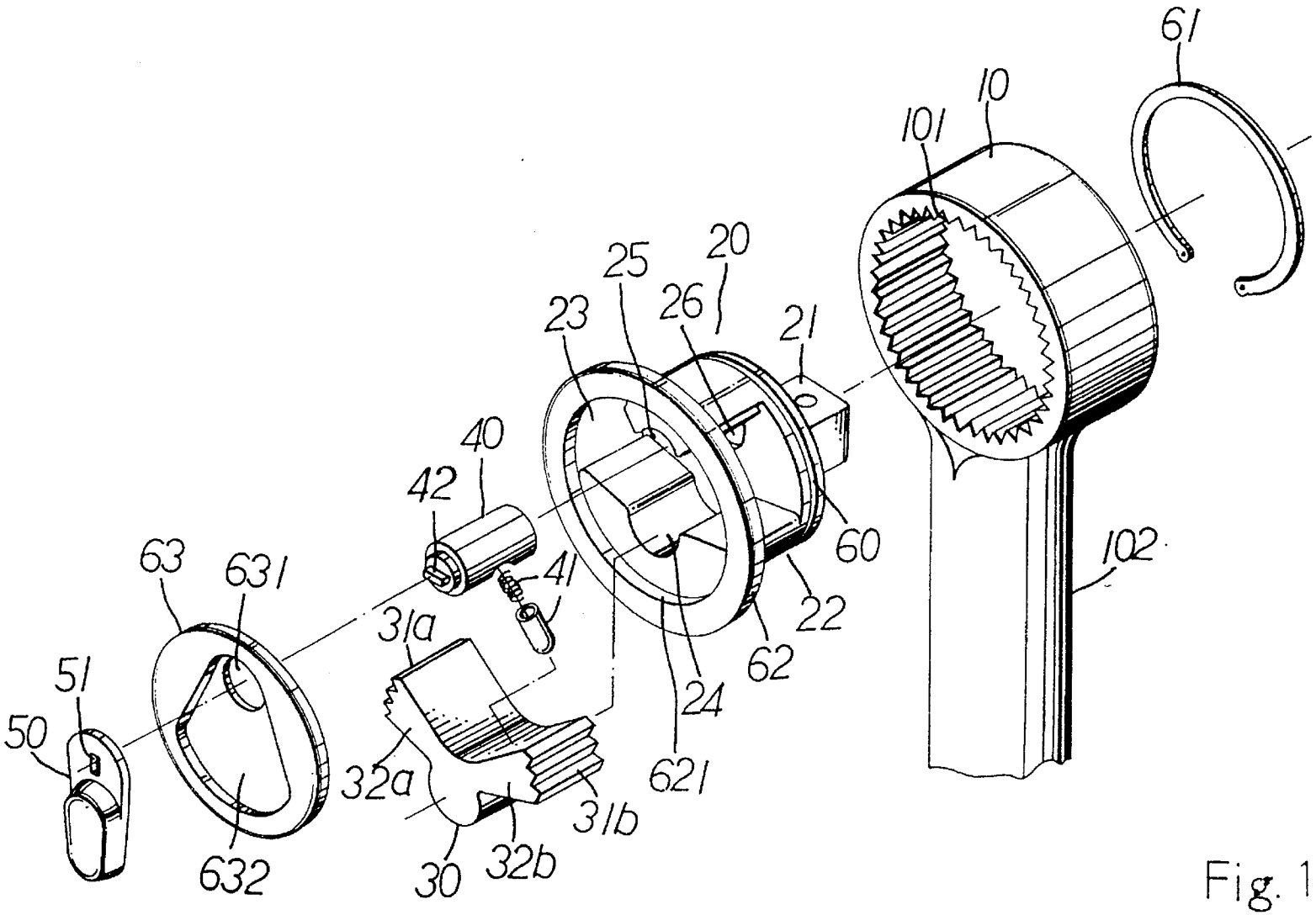
FIG. 1 shows an exploded view of the reversible ratchet wrench of the present invention, including the ratchet mechanism embodied in the present invention.

As shown in FIG. 1–4, a reversible ratchet wrench comprises a reversible ratchet mechanism of the embodiment of the present invention. The reversible ratchet mechanism comprises a hollow cylindrical head 10, a torsion transmitting element 20, a pawl 30, and a round rod 40 provided on the midsegment thereof with a spring-biased pin. The cylindrical head 10 has a center hole which is provided on the inner wall thereof with a plurality of teeth 101 extending axially and having respectively two converging inclined faces.

The torsion transmitting element 20 comprises a driving rod 21 and a cylindrical body 22 made integrally with the driving rod 21. The driving rod 21 has a square cross section. The cylindrical body 22 is provided axially with a V-shaped slot 23 which is in turn provided at the bottom thereof with an arcuate recess 24. The V-shaped slot 23 is further provided on two top ends thereof with two openings located on the periphery of the cylindrical body 22. The cylindrical body 22 is further provided radially with another arcuate recess 25 corresponding in location to the arcuate recess 24. The cylindrical body 22 is still further provided axially with a round recess 26 contiguous to the driving rod 21. The round recess 26 and the arcuate recess 25 are corresponding in radius to each other and are concentric. The cylindrical body 22 is received rotatably in the center hole of the cylindrical head 10 while the driving rod 21 is extended vertically out of one side of the cylindrical head 10.

The pawl 30 is of a V-shaped construction and is similar in size and shape to the V-shaped slot 23. The pawl 30 has two arms 32*a* and 32*b*, which form an angle smaller than the V-shaped slot 23. The arms 32*a* and 32*b* are provided respectively on the top end thereof with pawl teeth 31*a* and 31*b*, which are corresponding in location to the teeth 101 of the cylindrical head 10. The V-shaped pawl 30 is fastened pivotally in the V-shaped slot 23 of the cylindrical body 22 such that the pawl teeth 31*a* and 31*b* are located respectively in the openings of the V-shaped slot 23.

The round rod 40 is provided at the midsegment thereof with a spring-biased pin 41 and at one end thereof with a tetragonal projection 42 having a square cross section. The round rod 40 has another end which is slightly smaller in radius than the round recess 26 of the cylindrical body 22. The round rod 40 can be therefore fastened pivotally and axially in the round recess 26 such that the tetragonal projection 42 is located farther from the driving rod 21, and that the spring-biased pin 41 presses radially against the inner side of the V-shaped pawl 30.

Figure 2:
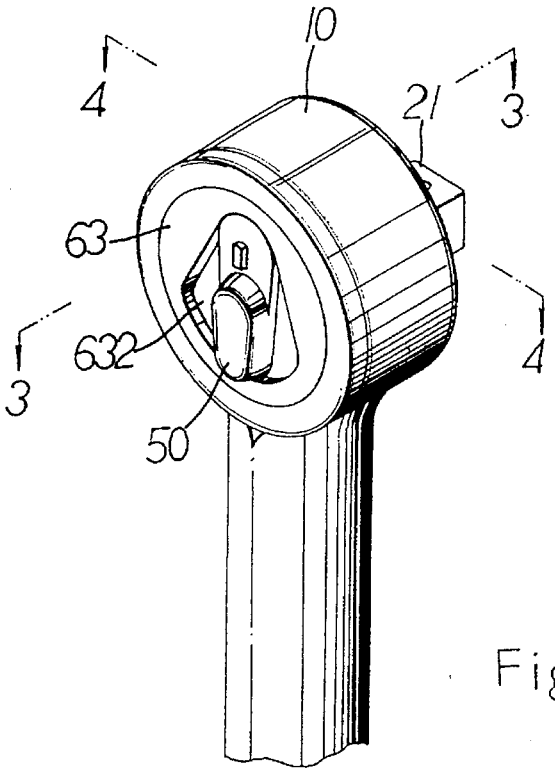
FIG. 2 shows a perspective view of the reversible ratchet wrench in combination according to the present invention.
Figure 3:
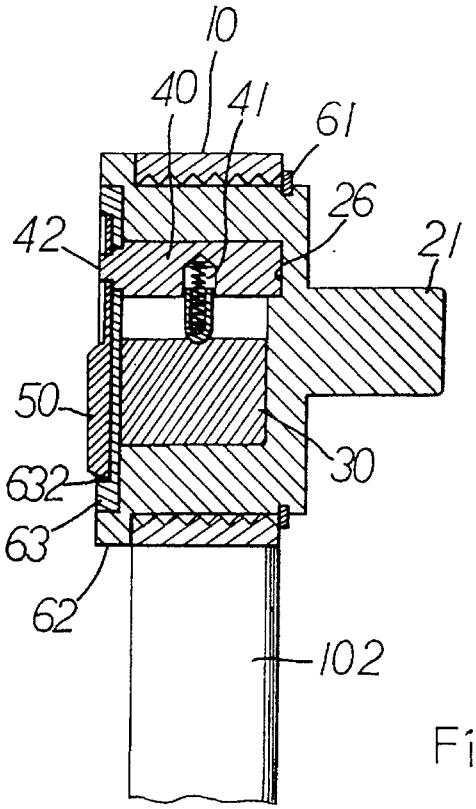
FIG. 3 shows a sectional view of a portion taken along the line 3—3 as shown in FIG. 2.
Figure 4:
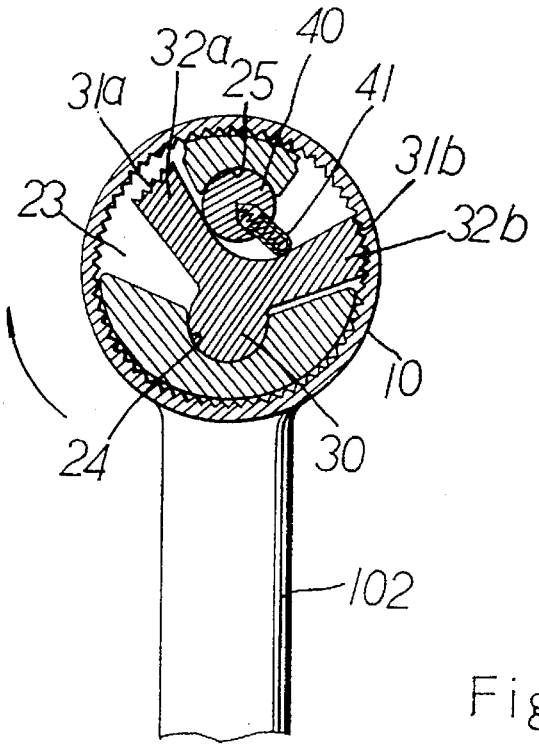
FIG. 4 shows a sectional view of a portion taken along the line 4—4 as shown is FIG. 2.
Figure 5:
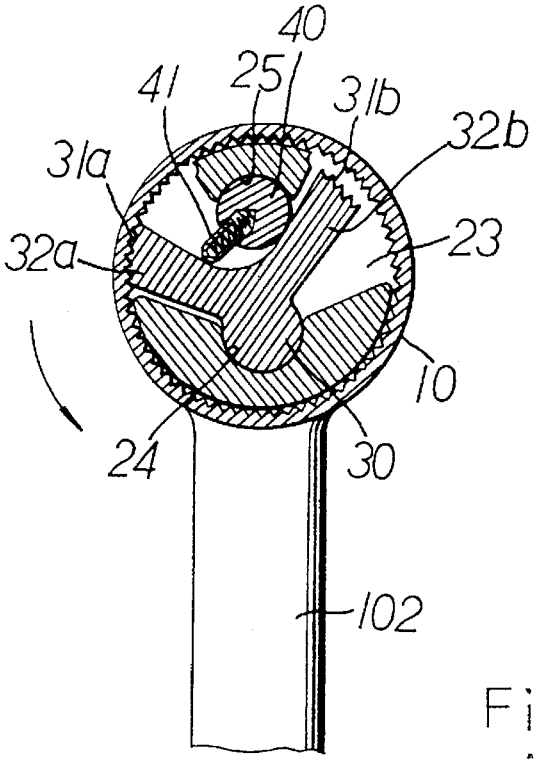
FIG. 5 shows a sectional view similar to FIG. 4, with the exception that the driving direction of the wrench is changed.

In addition to the reversible ratchet mechanism described above, the reversible ratchet wrench of the present invention comprises a handle 102, a fastening mechanism, and a rotating button 50. The handle 102 is extended outwards and vertically from the periphery of the cylindrical head 10. The reversible ratchet mechanism is fastened in the center hole of the cylindrical head 10 by the fastening mechanism. The rotating button 50 is fastened securely to the tetragonal projection 42 of the round rod 40. The fastening mechanism comprises a circular groove 60 located between the cylindrical body 22 and the driving rod 21, a C-shaped ring 61 dimensioned to fit into the circular groove 60, a flange 62 which is located on the cylindrical body 22 and is away from the driving rod 21, and a cover 63 for covering the V-shaped slot 23. The cover 63 is forced to be mounted on the inner circumferential surface 621 of the flange 62. The cover 63 has a hole 631 through which the tetragonal projection 42 of the round rod 40 can pass. The rotating button 50 has a square hole 51 corresponding in dimension and location to the tetragonal projection 42. In other words, the tetragonal projection 42 is received in the square hole 51 such that the round rod 40 is actuated when the rotating button 50 is turned. As shown in FIGS. 4 and 5, the spring-biased pin 41 of the round rod 40 presses against the inner side of the V-shape pawl 30 such that the pin 41 moves back and forth between two arms 32*a* and 32*b* of the pawl 30. The cover 63 has a surface which makes contact with the rotating button 50 and is provided with a sectoral recess 632 intended to limit the range in which the rotating button 50 can be turned. As a result, the round rod 40 can be prevented from being turned excessively, as shown in FIGS. 1 and 2. The sectoral recess 632 may be replaced by two projections which are spaced at an interval to form with the tetragonal projection 42 an isosceles.

By turning the rotating button 50, the clockwise driving direction of the reversible ratchet wrench of the present invention can be switched to the counterclockwise driving direction, and vice versa. When the spring-biased pin 41 of the reversible ratchet wrench of the present invention is located at the position as shown in FIG. 4, the driving direction is clockwise as indicated by an arrow in FIG. 4. In the meantime, the ratcheting is brought about in the counterclockwise direction. On the other hand, when the spring-biased pin 41 of the reversible ratchet wrench of the present invention is located at the position as shown in FIG. 5, the driving direction is counterclockwise as indicated by an arrow in FIG. 5. In the meantime the ratcheting is brought about in the clockwise direction.

The reversible ratchet wrench of the present invention described above in conjunction with FIG. 1–5 has a destructive torsion value greater than that of the proto-type reversible ratchet wrench of the prior art, because the present ratchet mechanism has a relatively large pawl, based on the space inside the wrench head, and an increased number of pawl teeth being engaged with the axial teeth of the wrench head. In addition, the manufacturing precision requirement of the reversible ratchet wrench of the present invention is less stringent as compared with the Snap-On reversible ratchet wrench of the prior art. It is therefore readily apparent that the reversible ratchet wrench of the present invention can be made easily and economically, and that the reversible ratchet wrench of the present invention has the advantage of having a high destructive torsion value.

The embodiment of the present invention described above is to be regarded in all respects as merely illustrative and not restrictive. Accordingly, the present invention may be embodied in other specific forms without deviating from the spirit thereof. The present invention is thereof to be limited only by the scope of the following appended claims.

What is claimed is:

1. A reversible ratchet mechanism comprising:

a cylindrical head of a hollow construction and having axially a center hole provided on an inner wall surface thereof with a plurality of teeth extending axially;

a torsion transmitting element provided at one end thereof with a driving rod and at another end thereof with a cylindrical body disposed rotatably in said center hole of said cylindrical head such that said driving rod is extended vertically from one side of said cylindrical head, said cylindrical body provided axially with a V-shaped slot having radially at a bottom thereof an arcuate recess, said V-shaped slot further having on two top ends thereof two openings spaced at an interval and located at a periphery of said cylindrical body;

a pawl of a V-shaped construction and having two arms which form an angle smaller than said V-shaped slot and which are provided respectively on a top end thereof with one or more pawl teeth, said pawl being fastened pivotally in said V-shaped slot such that said pawl teeth are located in said openings of said V-shaped slot; and a round rod provided at the midsegment of a longitudinal axis thereof with a spring-biased pin, said round rod being fastened pivotally and axially to said cylindrical body at a location between said two arms of said pawl such that said pin presses radially against an inner side of said pawl, wherein said round rod is capable of being rotated so as to cause said pin to press against either one of said two arms of said pawl, thereby resulting in the engagement of said pawl teeth of said pressed arm with said teeth of said center hole of said cylindrical head.

2. A reversible ratchet wrench comprising:

the reversible ratchet mechanism as claimed in claim 1;

a handle extended outwards and vertically from a periphery of said cylindrical head;

a fastening mechanism for fastening said reversible ratchet mechanism in said center hole of said cylindrical head; and a rotating button fastened to one end of said round rod of said ratchet mechanism, said one end of said round rod being farther from said driving rod.

3. The reversible ratchet wrench as defined in claim 2, wherein said fastening mechanism comprises:

a circular groove located between said cylindrical body and said driving rod;

a C-shaped ring dimensioned to fit into said circular groove;

a flange formed on one end of said cylindrical body, with said one end of said cylindrical body being farther from said driving rod; and a cover fastened to said farther end of said cylindrical body such that said V-shaped slot is covered by said cover, said cover having a hole through which said farther end of said round rod of said reversible ratchet mechanism passes and fastens to said rotating button.

4. The reversible ratchet wrench as defined in claim 3, wherein said cover has a surface which makes contact with said rotating button and is provided with a sectoral recess or two separated projections for limiting the range in which said rotating button can be rotated.

* * * * *